United States Patent [19]

Pratt

[11] Patent Number: 4,814,732

[45] Date of Patent: Mar. 21, 1989

[54] MAGNETIC LATCHING ACTUATOR

[75] Inventor: George B. Pratt, Portland, Oreg.

[73] Assignee: Tektronix, Inc., Beaverton, Oreg.

[21] Appl. No.: 90,647

[22] Filed: Aug. 28, 1987

[51] Int. Cl.[4] ..... H01F 7/08

[52] U.S. Cl. ..... 335/230; 335/234; 335/81

[58] Field of Search ..... 335/229, 230, 234, 78, 335/79, 80, 81

[56] References Cited

U.S. PATENT DOCUMENTS 4,604,599 8/1986 Koehler ..... 335/234

4,730,175 3/1988 Ichikawa et al. ..... 335/234

*Primary Examiner*—George Harris

*Attorney, Agent, or Firm*—William S. Lovell; Jay K. Malkin

[57] ABSTRACT

A magnetic latching actuator is disclosed having an arrangement of components which cooperate to minimize internal friction, while ensuring smooth and efficient operation. The invention uses a core having at least one electrical coil. In communication with the core is a permanent magnet. The magnet is positioned against a U-shaped magnetic flux connector having two parallel plates. The plates are sufficiently spaced from each other to permit the passage of a U-shaped armature therebetween. The armature is movable between the plates of the flux connector, enabling the transfer of magnetic flux to the armature while avoiding frictional engagement between the armature and flux connector. The armature further includes two end portions each designed to alternately engage the core at opposite ends.

21 Claims, 2 Drawing Sheets

MAGNETIC LATCHING ACTUATOR

This invention generally relates to magnetic latching actuator devices, and more particularly to a magnetic latching actuator of improved design which operates in a fast and reliable manner.

In the use and operation of sophisticated electronic equipment, it is often necessary to work with high frequency signals. Devices in this category include the new generation of portable spectrum analyzer units, such as the 490 Series Spectrum Analyzers manufactured by Tektronix, Inc., of Beaverton, Ore. These and other spectrum analyzers are generally used to display the power distribution of an incoming signal as a function of frequency. They are useful in analyzing the characteristics of electrical waveforms since they repetitively sweep the frequency range of interest, and display all components of the input signal. Accordingly, this requires fast and efficient switching of input signals from one level to another.

Modern spectrum analyzers typically incorporate an attenuator, the operation of which is generally known in the art. An attenuator is basically a voltage divider capable of adjusting the amplitude of a wave without introducing undesired distortion. It must be able to work at wide frequency ranges, while maintaining the integrity of input signals.

Operation of the attenuator is dependent upon externally controlled electronic switching devices. Switching devices known in the art and useful for this purpose include those manufactured by Tektronix, Inc., of Beaverton, Ore. under Model No. 119-1008-00. The Model 119-1008-00 unit uses a fixed coil positioned on a plastic insulator having a central opening therethrough. A movable core passes through the opening. The movable core is connected to an armature which alternately reciprocates between two permanent magnets. Another switching device using somewhat different principles of operation is made by Tektronix, Inc. under Model No. 148-0145-00. Model No. 148-0145-00 uses a dual coil system, in which two opposed coils are mounted in a module. Positioned above the coils is an angled armature designed to move from one coil to another about a central pivot or fulcrum point.

The present invention involves an improved magnetic latching actuator usable in spectrum analyzers and other electronic devices where precise signal switching is important. The invention utilizes a magnetic system not heretofore known in the art which results in simplicity of operation, a high degree of efficiency, and a negligible degree of friction between moving parts. The reduction of internal friction enables the invention to be substantially maintenance free, as discussed below.

SUMMARY OF THE INVENTION

It is a main object of the present invention to provide an improved magnetic latching actuator having a unique arrangement of components which cooperate to minimize internal friction, while ensuring smooth and efficient operation. This objective is accomplished through the use of a fixed-position core having at least one electrical coil positioned thereon. In communication with the core at its midpoint is a fixed permanent magnet. The permanent magnet is positioned against a U-shaped magnetic flux connector having two parallel plates. The plates are sufficiently spaced from each other to permit the passage of a U-shaped armature therebetween. The armature is freely movable between the plates of the flux connector, thereby enabling the transfer of magnetic flux to the armature while avoiding frictional engagement between the armature and flux connector. The armature further includes two angled end portions each designed to alternately engage the core at opposite ends.

The objects, advantages, and features of the present invention will be more fully appreciated and understood through the following drawings and detailed description of a preferred embodiment provided below.

DETAILED DESCRIPTION OF A PREFERRED EMBODIMENT

Figure 1:
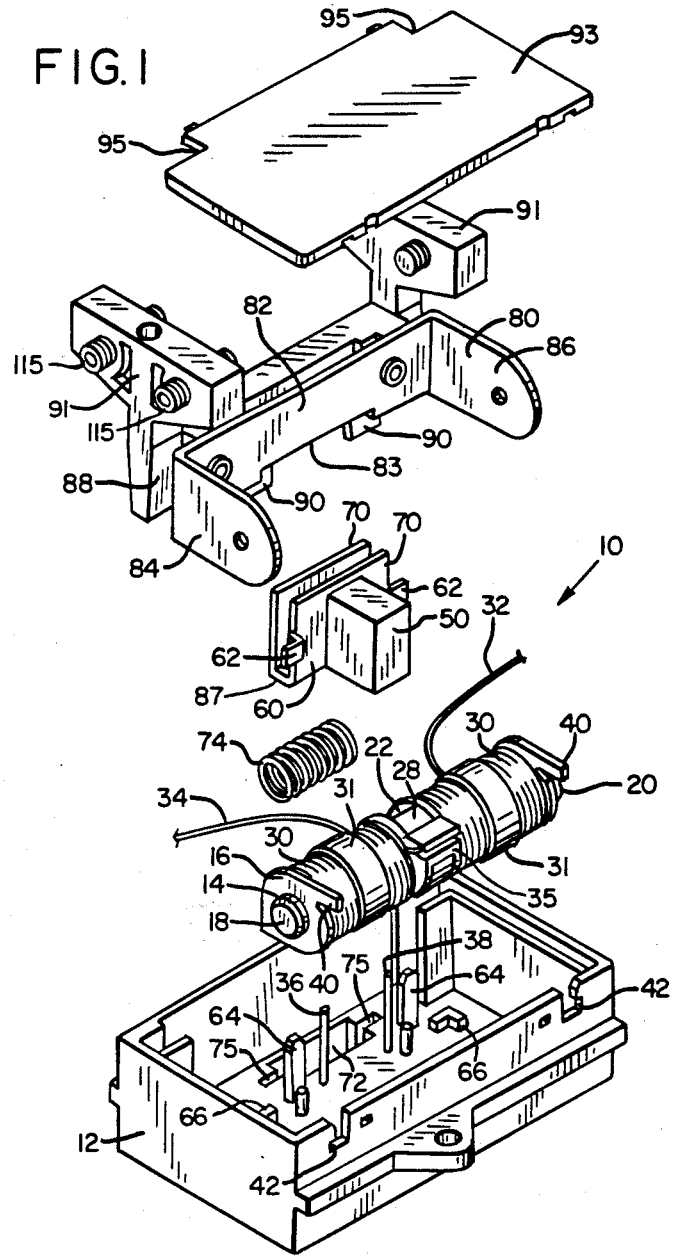
FIG. 1 is an exploded perspective view of the present invention.
Figure 2:
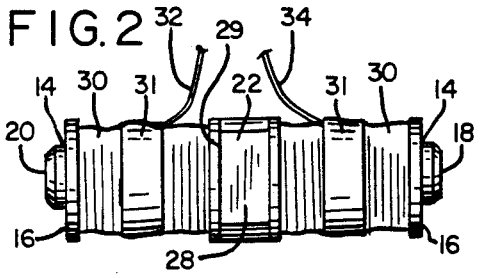
FIG. 2 is a side view of the core and associated components used in the invention specifically showing an opening in the insulating, material on the core at its midpoint, and exposure of the core at such position.
Figure 3:
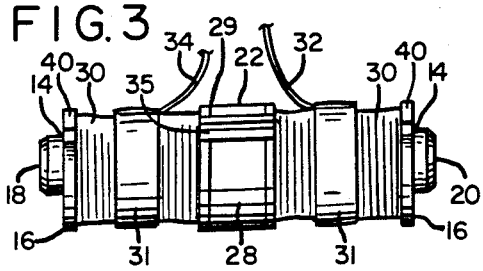
FIG. 3 is a side view of the core and associated components used in the invention specifically showing a grooved bridge portion in the insulating material on the core which allows passage of the coil wire from one end of the core to the other without touching the core.
Figure 5:
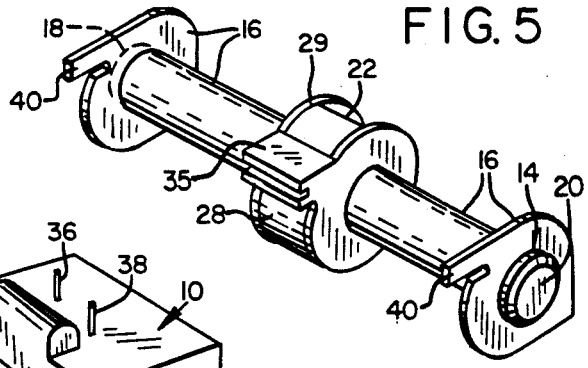
FIG. 5 is a perspective view of the core used in the invention, and the insulating material surrounding the core.

The present invention 10 represents a magnetic latching actuator of improved efficiency and design. The invention 10 is generally shown in FIG. 1, and includes a housing 12 preferably manufactured of shock resistant plastic (e.g. polycarbonate plastic). Fixedly positioned within the housing 12 is a core 14 manufactured of magnetically conductive metal (preferably soft iron) as illustrated in FIGS. 1–3 and 5–8. The exterior of the core 14 includes a plastic insulator 16 which is slightly shorter than the core 14 (FIGS. 2, 3 and 5). As a result, the ends 18, 20 of the core 14 extend slightly outward from the insulator 16.

Figure 8:
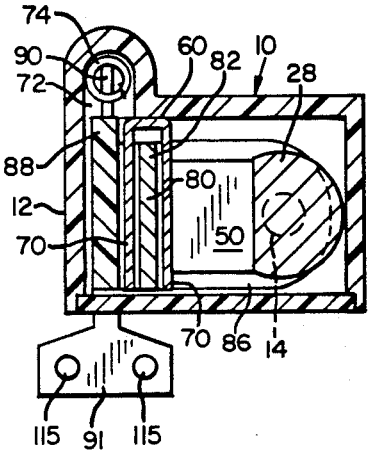
FIG. 8 is a sectional view taken along lines 8—8 of FIG. 4.

An enlarged semicircular portion 28 of core 14 is provided at the midpoint 22 of core 14 (FIGS. 5 and 8). The insulator 16 has a gap 29 adjacent the midpoint 22 of the core 14 permitting exposure of the semicircular portion 28 (FIGS. 2 and 3). Wrapped around the insulator 16 on both sides of the midpoint 22 is a coil 30 preferably constructed of copper magnet wire having synthetic insulation known in the art. In the present embodiment, the coil 30 is wrapped with tape 31 to maintain its structural integrity. At no time does the coil 30 ever contact the core 14.

Figure 4:
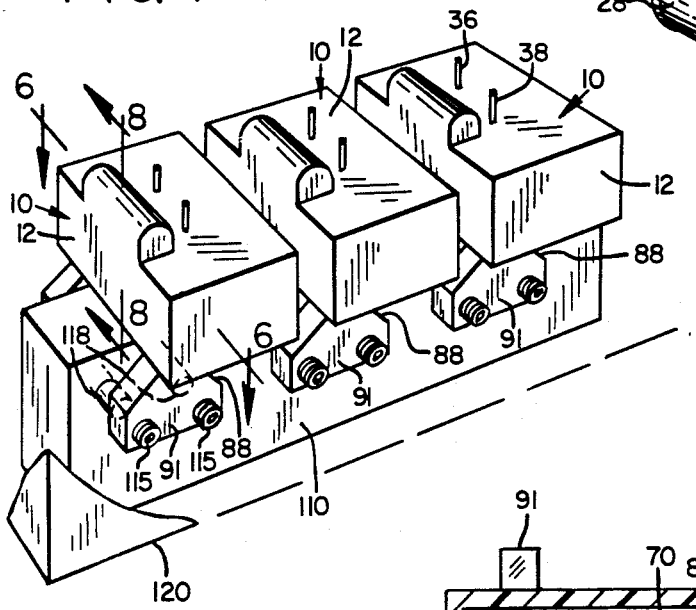
FIG. 4 is a perspective view of three units of the present invention mounted on an attenuator designed for use in a spectrum analyzer, the spectrum analyzer being shown schematically.

The wire from which coil 30 is constructed includes two ends 32, 34 on opposite sides of the midpoint 22 of the core 14 which are connected by soldering or the like to terminal posts 36, 38 (FIGS. 1 and 4). Terminal posts 36, 38 extend through the housing 12 to the exterior thereof. The terminal posts are preferably manufactured of phosphor bronze, and may be gold plated for solderability or low contact resistance to an appropriate connector. The terminal posts 36, 38 are adapted to receive external control signals from a selected source (not shown).

In the embodiment described herein, the coil 30 consists of a single portion of wire wrapped around the insulator 16 and core 14 from one end to the other. Passage of the wire across the midpoint 22 of the core 14 without touching the semicircular portion 28 is accomplished using a grooved bridge 35 in the insulator 16 as shown in FIGS. 3 and 5. The grooved bridge 35 extends across semicircular portion 28, and is sized for receipt of the wire used to construct coil 30.

In the alternative, it may be possible to have two separate coils, one on each side of the semicircular portion 28, each coil being connected to its own pair of terminal posts.

The assembly unit consisting of the core 14, insulator 16 and coil 30 is fixedly mounted within the housing 12. To accomplish this, the insulator 16 includes two tabs 40 (FIGS. 1 and 5) sized for engagement within two notched openings 42 in the housing 12, as illustrated in FIG. 1 Also, the ends of the insulator 16 engage two L-shaped projections 66 inside the housing 12 (FIG. 1).

Positioned directly against the semicircular portion 28 of the core 14 and in magnetic communication therewith is a permanent magnet 50 (FIG. 8). The magnet 50 is preferably of the Alnico type. Through contact with the semicircular portion 28, the permanent magnet 50 supplies magnetic flux to the core 14 as described in greater detail below. "Magnetic flux" is defined as the surface integral of the normal component of the magnetic induction over the area of material through which the flux passes.

With the core 14, insulator 16, coil 30, and magnet 50 mounted in a fixed position within the housing 12, a flux connector 60 is then positioned against the magnet 50, as indicated in FIGS. 1 and 8. The flux connector 60 is manufactured of a magnetically conductive metal (preferably soft iron). Soft iron is preferred since it is characterized by a low degree of reluctance. For the purposes of this invention, reluctance is defined as the opposition in a circuit to the establishment of magnetic flux. It is technically analogous to resistance in an electrical circuit. The flux connector 60 further includes mounting tabs 62 which frictionally engage pins 64 in the housing 12 (FIG. 1). In this configuration, the flux connector 60 is fixedly secured against the magnet 50 as shown.

The flux connector 60 is substantially U-shape in cross section (FIG. 8), and includes two parallel plates 70 which are spaced apart from each other. In a preferred form of the invention 10, a space of approximately 0.078 inch exists between the parallel plates 70.

Positioned within a slot 72 in the housing 12 is a spring 74 (FIG. 1). The slot 72 has narrowed end portions 75 on each side thereof, the function of which will be explained hereinafter.

A substantially U-shaped armature 80 is then mounted within the housing 12 as illustrated in FIGS. 1 and 6–8. The armature 80 includes an elongate medial portion 82 and two end portions 84, 86. The medial portion 82 includes an indented region 83 which prevents contact between the medial portion 82 and the bottom 87 of the flux connector 60. The end portions 84, 86 form substantially a 90 degree angle relative to the medial portion 82. When mounted in the housing 12, the medial portion 82 of the armature 80 is positioned between the parallel plates 70 of the flux connector 60 (FIG. 8). The medial portion 82 is preferably 0.048 inch thick, thus allowing it to freely pass between the plates 70. At no time does the medial portion 82 contact either of the plates 70 during operation of the invention 10. This construction enables magnetic flux to freely pass from the magnet 50 to the flux connector 60 into the armature 80, while at the same time avoiding destructive frictional engagement between the armature 80 and flux connector 60. For this reason, the present invention is characterized by a high degree of reliability, as indicated above.

Figure 6:
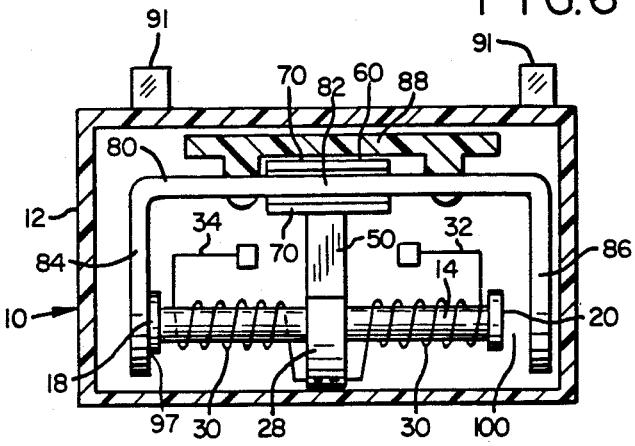
FIG. 6 is a partially schematic sectional view taken along lines 6—6 of FIG. 4 with the armature shown in a latched position against one end of the core.
Figure 7:
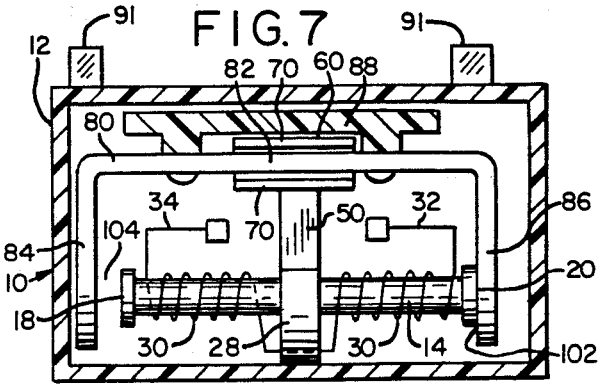
FIG. 7 is a partially schematic sectional view substantially identical to that of FIG. 6 except for the armature which is shown in a latched position against the opposite end of the core from that shown in FIG. 6.

When mounted in the housing 12, the end portions 84, 86 of the armature 80 are positioned adjacent ends 18, 20 of the core 14 as illustrated in FIGS. 6 and 7. The armature 80 is designed for reciprocating movement so that end portion 84 can move alternately toward and away from the end 18, with the end portion 86 moving toward and away from the end 20, as will be more fully described in the "Operation" section below.

Finally, attached to the armature 80 is a yoke member 88 shown in FIG. 1 designed to transfer the reciprocating motion of the armature 80 to the exterior of the housing 12. The yoke member 88 includes tabs 90 sized for receipt within the narrowed end portions 75 of the slot 72 (FIG. 8). As the armature 80 reciprocates, tabs 90 push against the ends of the spring 74, as described below.

The ultimate design of the yoke member 88 may be varied, and the yoke member 88 shown in FIGS. 1 and 4 is constructed for use with an attenuator in a spectrum analyzer, as will also be discussed below.

The yoke member 88 of FIG. 1 further includes legs 91 which extend beyond the exterior of the housing 12. A cover 93 is positioned on the housing 12 and locked in place. The cover 93 includes openings 95 sized to allow the reciprocating motion of legs 91.

Operation

In operation, the terminal posts 36, 38 of the invention are first connected to a suitable signal source known in the art. FIG. 6 shows the invention 10 in a rest position. Orientation in this position is caused by the entry of flux from the permanent magnet 50 into the core 14 which causes the end portion 84 of the armature 80 to move toward and against end 18 of the core 14. This creates a condition known as a "closed gap" between end portion 84 and end 18, designated by reference number 97. Likewise, an open gap 100 exists between the end portion 86 of the armature 80 and the end 20 of the core 14. Due to the greater magnetic reluctance of the open gap 100, it only receives a small amount of flux which becomes dispersed as it crosses the open gap 100. Most of the flux is concentrated at the closed gap 97 between the end portion 84 of the armature 80 and end 18 of the core 14. As a result, the armature 80 is magnetically latched in the position shown in FIG. 6.

A completed magnetic circuit is created by the flow of flux across the open gap 100, and the flow of flux from end 18 of the core 14 to end portion 84 of the armature 80. Such flux continues to flow through the armature 80, enters the flux connector 60, and returns to the magnet 50 to complete the circuit.

When the coil 30 receives an electrical impulse of reverse polarity through the terminal posts 36, 38, the flux at the closed gap 97 between end portion 84 of the armature 80 and end 18 of the core 14 decreases, while the flux through the open gap 100 increases. As a result, the latching force of the invention 10 as previously described becomes sufficiently over-balanced so that the armature 80 moves to its alternate position illustrated in FIG. 7. In this position, the end portion 86 of the armature 80 contacts the end 20 of the core 14 creating a closed gap 102 between these components. Likewise, an open gap 104 is created between the end portion 84 of the armature 80 and the end 18 of core 14. As additional electrical impulses of alternately positive and negative polarity are received, this process continuously repeats. In the absence of any electrical impulses, flux from the magnet 50 causes the armature 80 to remain latched at the position established by the last-received impulse.

The spring 74 in position within the slot 72 facilitates smooth and near-instantaneous movement of the armature 80. When either of the end portions 84, 86 of the armature 80 contacts the core 14, spring 74 is compressed within the slot 72 by one of the tabs 90 on the yoke member 88. Specifically, the tab 90 nearest the point of contact between armature 80 and core 14 moves through a narrowed end portion 75 of the slot 72 against the spring 74. When a change in system polarity occurs, the armature 80 is released, and spring 74 pushes against the tab 90 and yoke member 88 causing near-instantaneous movement of the armature 80 to its opposite position.

As illustrated in FIG. 4, the invention 10 is shown attached to an attenuator unit 110 designed for use in a spectrum analyzer 120 (shown schematically) like those manufactured by Tektronix, Inc. of Beaverton, Ore. under the designation "490 Series. " Three units of the invention 10 are used, and are positioned with the legs 91 of each yoke member 88 facing downward. The legs 91 of the yoke member 88 include adjustable drive screws 115 which engage a plurality of pins 118 in the attenuator unit 110 (FIG. 4). When the units of the invention 10 are activated, the yoke members 88 and legs 91 move back and forth, causing corresponding movement of the pins 118 which are connected to the internal operational components of the attenuator unit 110. In this manner, the precise switching of signals by the attenuator unit 110 can be accomplished.

As discussed herein, the present invention is chiefly characterized by a minimal number of moving parts and corresponding elimination of frictional damage and operational variations associated therewith. The flux connector 60 transmits flux between the magnet 50 and the armature 80 without frictional contact between these two components. This results in a low reluctance connection that places negligible lateral force on the armature 80 which ultimately reduces friction in the system. Furthermore, as illustrated above, only one closed gap exists between the armature 80 and the core 14 at either latched position shown in FIGS. 6 and 7, unlike prior art devices which transmit flux through the armature using two closed gaps for each latched position. The use of two closed gaps invariably causes problems since small dimensional variations often allow one of the closed gaps to remain slightly open while the other closes completely. As described above, these problems are effectively avoided by the present invention 10.

Having herein described a preferred embodiment of the present invention, it is contemplated that the scope of the invention shall include all modifications apparent to those skilled in the art, and shall only be construed in accordance with the following claims.

What is claimed is:

1. A magnetic latching actuator comprising:

a housing;

a magnet;

a magnetically conductive core in contact with said magnet;

at least one coil positioned around said core and insulated therefrom;

a magnetically conductive armature mounted for reciprocating motion within said housing; and means in contact with said magnet for transferring magnetic flux from said magnet to said armature, said means being mounted externally from said coil and said core, said means being spaced from said armature in an amount sufficient to allow the transfer of magnetic flux thereto, while avoiding direct contact with said armature.

2. The magnetic latching actuator of claim 1 wherein said magnetically conductive core comprises a first end, a second end, and a medial portion therebetween, said core further comprising a layer of electrically insulating material thereon, said layer having an open region at said medial portion so as to expose said medial portion of said core.

3. The magnetic latching actuator of claim 2 wherein said magnet is positioned against said exposed medial portion of said core, wherein magnetic flux is allowed to flow from said magnet into and through said core.

4. The magnetic latching actuator of claim 2 wherein said coil comprises at least one length of wire wrapped around said insulating material on said core, said length of wire having at least two ends, each end being attached to an electrically conductive member extending through said housing to the exterior thereof.

5. The magnetic latching actuator of claim 2 wherein said means for transferring magnetic flux comprises a flux transfer member in contact with said magnet comprising two parallel plates spaced apart from each other in an amount sufficient to allow the unrestricted passage of said armature therebetween, wherein said magnetic flux from said magnet is allowed to pass from said plates of said flux transfer member to said armature while avoiding the direct contact of said armature with said plates of said flux transfer member.

6. The magnetic latching actuator of claim 5 wherein said armature comprises a medial portion having a thickness less than the space between said parallel plates of said flux transfer member, and first and second end portions, said first end portion of said armature being adjacent to and movable against said first end of said core, with said second end portion of said armature being adjacent to and movable against said second end of said core, said armature being mounted within said housing so that when said first end portion of said armature is moved against said first end of said core, a gap is created between said second end of said core and said second end portion of said armature, and when said second end portion of said armature is moved against said second end of said core, a gap is created between said first end of said core and said first end portion of said armature.

7. The magnetic latching actuator of claim 6 further comprising biasing means for facilitating the movement of said first end portion of said armature toward said first end of said core, and for facilitating the movement of said second end portion of said armature toward said second end of said core.

8. The magnetic latching actuator of claim 7 wherein said biasing means comprises a spring operably connected to said armature.

9. The magnetic latching actuator of claim 1 further comprising at least one extension member secured to said armature through said housing and positioned along the outside thereof, said extension member allowing the transfer of reciprocating motion from said armature in the interior of said housing to the exterior thereof.

10. A magnetic latching actuator comprising:

a housing;

a magnet;

a magnetically conductive core in contact with said magnet;

at least one coil positioned around said core and insulated therefrom;

a magnetically conductive armature mounted for reciprocating motion within said housing comprising a medial portion, and first and second end portions and a flux transfer member in contact with said magnet comprising two parallel plates spaced apart from each other in an amount sufficient to allow the unrestricted passage of said medial portion of said armature therebetween, wherein said magnetic flux from said magnet is allowed to pass from said plates of said flux transfer member to said armature while avoiding the direct contact of said armature with said plates of said flux transfer member.

11. The magnetic latching actuator of claim 10 wherein said magnetically conductive core comprises a first end, a second end, and a medial portion therebetween, said core further comprising a layer of electrically insulating material thereon, said layer having an open region at said medial portion so as to expose said medial portion of said core.

12. The magnetic latching actuator of claim 11 wherein said magnet is positioned against said exposed medial portion of said core, wherein magnetic flux is allowed to flow from said magnet into and through said core.

13. The magnetic latching actuator of claim 11 wherein said coil comprises at least one length of wire wrapped around said insulating material on said core, said length of wire having at least two ends, each end being attached to an electrically conductive member extending through said housing to the exterior thereof.

14. The magnetic latching actuator of claim 11 wherein said medial portion of said armature has a thickness less than the space between said parallel plates of said flux transfer member, said first end portion of said armature being adjacent to and movable against said first end of said core, with said second end portion of said armature being adjacent to and movable against said second end of said core, said armature being mounted within said housing so that when said first end portion of said armature is moved against said first end of said core, a gap is created between said second end of said core and said second end portion of said armature, and when said second end portion of said armature is moved against said second end of said core, a gap is created between said first end of said core and said first end portion of said armature.

15. The magnetic latching actuator of claim 14 further comprising biasing means for facilitating the movement of said first end portion of said armature toward said first end of said core, and for facilitating the movement of said second end portion of said armature toward said second end of said core.

16. The magnetic latching actuator of claim 15 wherein said biasing means comprises a spring operably connected to said armature.

17. A magnetic latching actuator comprising:

a housing;

a magnet;

a magnetically conductive core in contact with said magnet comprising a first end, a second end, and a medial portion therebetween, said core further comprising a layer of electrically insulating material thereon, said layer having an open region at said medial portion so as to expose said medial portion of said core, said magnet being positioned against said exposed medial portion of said core, wherein magnetic flux is allowed to flow from said magnet into and through said core;

at least one coil positioned around said core and insulated therefrom, said coil comprising at least one length of wire wrapped around said insulating material on said core, said length of wire having at least two ends, each end being attached to an electrically conductive member extending through said housing to the exterior thereof;

a magnetically conductive armature mounted for reciprocating motion within said housing comprising a medial portion, and first and second end portions, said first end portion of said armature being adjacent to and movable against said first end of said core, with said second end portion of said armature being adjacent to and movable against said second end of said core, said armature being mounted within said housing so that when said first end portion of said armature is moved against said first end of said core, a gap is created between said second end of said core and said second end portion of said armature, and when said second end portion of said armature is moved against said second end of said core, a gap is created between said first end of said core and said first end portion of said armature;

a flux transfer member in contact with said magnet comprising two parallel plates spaced apart from each other in an amount sufficient to allow the unrestricted passage of said armature therebetween, wherein said magnetic flux from said magnet is allowed to pass from said plates of said flux transfer member to said armature while avoiding the direct contact of said armature with said plates of said flux transfer member;

biasing means for facilitating the movement of said first end portion of said armature toward said first end of said core, and for facilitating the movement of said second end portion of said armature toward said second end of said core comprising a spring operably connected to said armature; and at least on extension member secured to said armature through said housing and positioned along the outside thereof, said extension member allowing the transfer of reciprocating motion from said armature in the interior of said housing to the exterior thereof.

18. A spectrum analyzer system comprising:

means for analyzing the frequency of input signals;

attenuation means for adjustably controlling the amplitude of said signals;

a magnetic latching actuator coupled to said attenuation means comprising:

a housing;

a magnet;

a magnetically conductive core in contact with said magnet;

at least one coil positioned around said core and insulated therefrom;

a magnetically conductive armature mounted for reciprocating motion within said housing; and means in contact with said magnet for transferring magnetic flux from said magnet to said armature, said means being mounted externally from said coil and said core, said means being spaced from said armature in an amount sufficient to allow the transfer of magnetic flux thereto, while avoiding direct contact with said armature.

19. The magnetic latching actuator of claim 18 wherein said means for transferring magnetic flux comprises a flux transfer member in contact with said magnet comprising two parallel plates spaced apart from each other in an amount sufficient to allow the unrestricted passage of said armature therebetween, wherein said magnetic flux from said magnet is allowed to pass from said plates of said flux transfer member to said armature while avoiding the direct contact of said armature with said plates of said flux transfer member.

20. The magnetic latching actuator of claim 19 wherein said armature comprises a medial portion having a thickness less than the space between said parallel plates of said flux transfer member, and first and second end portions, said first end portion of said armature being adjacent to and movable against said first end of said core, with said second end portion of said armature being adjacent to and movable against said second end of said core, said armature being mounted within said housing so that when said first end portion of said armature is moved against said first end of said core, a gap is created between said second end of said core and said second end portion of said armature, and when said second end portion of said armature is moved against said second end of said core, a gap is created between said first end of said core and said first end portion of said armature.

21. A spectrum analyzer system comprising:

means for analyzing the frequency of input signals;

attenuation means for adjustably controlling the amplitude of said signals;

a magnetic latching actuator coupled to said attenuation means comprising:

a housing;

a magnet;

a magnetically conductive core in contact with said magnet comprising a first end, a second end, and a medial portion therebetween, said core further comprising a layer of electrically insulating material thereon, said layer having an open region at said medial portion so as to expose said medial portion of said core, said magnet being positioned against said exposed medial portion of said core, wherein magnetic flux is allowed to flow from said magnet into and through said core;

at least one coil positioned around said core and insulated therefrom, said coil comprising at least one length of wire wrapped around said insulating material on said core, said length of wire having at least two ends, each end being attached to an electrically conductive member extending through said housing to the exterior thereof;

a magnetically conductive armature mounted for reciprocating motion within said housing comprising a medial portion, and first and second end portions, said first end portion of said armature being adjacent to and movable against said first end of said core, with said second end portion of said armature being adjacent to and movable against said second end of said core, said armature being mounted within said housing so that when said first end portion of said armature is moved against said first end of said core, a gap is created between said second end of said core and said second end portion of said armature, and when said second end portion of said armature is moved against said second end of said core, a gap is created between said first end of said core and said first end portion of said armature;

a flux transfer member in contact with said magnet comprising two parallel plates spaced apart from each other in an amount sufficient to allow the unrestricted passage of said armature therebetween, wherein said magnetic flux from said magnet is allowed to pass from said plates of said flux transfer member to said armature while avoiding the direct contact of said armature with said plates of said flux transfer member;

biasing means for facilitating the movement of said first end portion of said armature toward said first end of said core, and for facilitating the movement of said second end portion of said armature toward said second end of said core comprising a spring operably connected to said armature; and at least one extension member secured to said armature through said housing and positioned along the outside thereof, said extension member allowing the transfer of reciprocating motion from said armature in the interior of said housing to the exterior thereof.

* * * * *